US005378537A

United States Patent [19]

Masuda et al.

[11] Patent Number: 5,378,537

[45] Date of Patent: Jan. 3, 1995

[54] POLYESTER MONOFILAMENT

[75] Inventors: Toyohiko Masuda, Shizuoka; Takehiko Miyoshi, Mishima; Yoshinori Horii, Shizuoka, all of Japan

[73] Assignee: Toray Industries, Inc., Japan

[21] Appl. No.: 861,821

[22] PCT Filed: Oct. 15, 1991

[86] PCT No.: PCT/JP91/01405

§ 371 Date: Jun. 17, 1992

§ 102(e) Date: Jun. 17, 1992

[87] PCT Pub. No.: WO92/07162

PCT Pub. Date: Apr. 30, 1992

[30] Foreign Application Priority Data

Oct. 19, 1990 [JP] Japan ..... 2-282819

[51] Int. Cl.[6] ..... D02G 3/00

[52] U.S. Cl. ..... 428/364; 525/437; 525/440; 525/443; 525/445; 525/454; 525/455; 528/310; 528/397; 528/401; 524/195; 524/602; 524/605; 524/612; 428/397

[58] Field of Search ..... 525/437, 440, 443, 445, 525/454, 455; 528/310, 397, 401; 524/195, 602, 605, 612; 428/364, 397

[56] References Cited

U.S. PATENT DOCUMENTS

| | | | |
|---|---|---|---|
| 4,064,103 | 12/1977 | Cordes et al. | 524/195 |
| 4,081,422 | 3/1978 | Cordes et al. | 524/130 |
| 4,395,308 | 7/1983 | Dawes | 162/232 |
| 5,246,992 | 9/1993 | Wick et al. | 524/195 |

FOREIGN PATENT DOCUMENTS

| | | |
|---|---|---|
| 58-023915 | 2/1983 | Japan . |
| 58-23916 | 2/1983 | Japan . |
| 60-215813 | 10/1985 | Japan . |
| 61-43300 | 2/1986 | Japan . |
| 62-231094 | 10/1987 | Japan . |
| 1-15604 | 3/1989 | Japan . |
| 645658 | 10/1984 | Switzerland . |

*Primary Examiner*—Samuel A. Acquah
*Attorney, Agent, or Firm*—Austin R. Miller

[57] ABSTRACT

The polyester monofilament of this invention has a terminal carboxyl group concentration of not more than 10 equivalent weights/$10^6$ g and contains an unaltered carbodiimide compound in an amount in the range of from 0.005 to 1.5% by weight and a fluorine type polymer in an amount in the range of from 0.01 to 30% by weight. The polyester monofilament of this invention has an excellent resistance to hydrolysis and proof against staining. When used under high temperature and high humidity conditions susceptible to hydrolysis and the collection of stains, as when used in a papermaking drier canvas, it brings about a notable effect of prolonging the service life of the canvas and lengthening the cycle of cleaning.

10 Claims, 2 Drawing Sheets

POLYESTER MONOFILAMENT

TECHNICAL FIELD

This invention relates to a polyester monofilament which combines a resistance to hydrolysis with a repellency of water and oil and a proof against staining, and more particularly, to a polyester monofilament ideally usable as a component thread for a paper-making quality drier canvas and having a superior resistance to hydrolysis and proof against staining compared with the conventional countertype.

BACKGROUND ART

Since the polyester monofilament possesses a prominent shear strength, acid-resistance, and dimensional stability, it has found extensive utility in papermaking drier canvas, papermaking wire, various brushes, writing brushes, plain gauze for printing screens, and fishing lines, for example. When used under conditions susceptible to hydrolysis, because of a hot moist ambient air, as when employed as a component thread in a papermaking drier canvas, it gradually undergoes deterioration and a loss of tenacity with use, and at the same time, suffers an adhesion thereto and accumulation thereon of a stain comprising filling material, sizing agent, paper strength reinforcing agent and various other papermaking raw materials incorporated in the papermaking dope. Thus, this is disadvantageous in that it imposes restrictions as on the duration of safe use and the conditions of effective use thereof, and compels the canvas to be cleaned at frequent intervals. Various proposals have been made for ridding the polyester monofilament of such drawbacks as mentioned above.

As one example of the means of improving the resistance of the polyester monofilament to hydrolysis, a species of polyester monofilament having a specific amount of a polyolefin such as polyethylene, polypropylene, polybutene, poly-4-methyl pentene-1, or polystyrene incorporated in polyester is known (Japanese Unexamined Patent Publication No. 51-136923). The monofilament obtained by this particular technique, such as, for example, the monofilament made of a polyethylene-containing polyethylene terephthalate, exhibits a poor tenacity and a low resistance to hydrolysis, and therefore, lacks practicability.

Methods of improving the resistance of polyester to hydrolysis by adding a carbodiimide compound thereto are also known to the art. A method of forming a polyester filament containing no unaltered carbodiimide by adding a mono- or bis-carbodiimide compound to polyester, and quickly mixing them and spinning the resultant mixture (Japanese Unexamined Patent Publication No. 50-95517), a method which comprises adding a polycarbodiimide compound containing at least three carbodiimide radicals in the molecular unit thereof (Japanese Examined Patent Publication No. 38-15220), a polyester monofilament for a papermaking canvas having a specific amount of a specific carbodiimide compound retained in an unaltered form in polyester (Japanese Unexamined Patent Publication No. 58-23916), and a method of producing an industrial grade polyester filament having a specific carbodiimide compound incorporated in a polyester containing a specific amount of phosphorus atoms (Japanese Unexamined Patent Publication No. 57-205518) have been proposed, for example.

Various techniques have been proposed for improving the resistance of polyester fibers to staining. A technique for treating a textile product with a fluorine-containing compound (Japanese Unexamined Patent Publication No. 52-5400 and Japanese Unexamined Patent Publication No. 58-46123), core-sheath composite fibers using a sheath of fluorine resin (Japanese Unexamined Patent Publication No. 53-31851), a composition containing a perfluoroalkylsulfonate (Japanese Unexamined Patent Publication No. 59-66449), fibers containing fluorine resin (Japanese Unexamined Patent Publication No. 62-238822), and fibers containing minute fluorine resin particles (Japanese Unexamined Patent Publication No. 2-26919) are known to the art, but these known techniques cannot simultaneously satisfy the required two properties i.e., a resistance to hydrolysis and proof against staining.

In recent years, the conditions under which the polyester monofilament is used, as for the papermaking drier canvas, have become very strict, and to enhance the productivity of paper and prevent degradation of the paper quality, the desirability of a polyester monofilament combining a still better resistance to hydrolysis with an outstanding proof against staining has become necessary.

An object of this invention is to provide a polyester monofilament which cosines an excellent resistance to hydrolysis with a proof against staining, and is usable for a papermaking drier canvas.

DISCLOSURE OF THE INVENTION

The object of this invention is accomplished by a polyester monofilament having a terminal carboxyl group concentration of not more than 10 equivalent weights/$10^6$ g and containing a carbodiimide compound in an unaltered form in an amount of not less than 0.005% by weight and not more than 1.5% by weight, and a fluorine type polymer in an amount of not less than 0.01% by weight and not more than 30% by weight.

This invention will be described in detail below.

The polyester of this invention preferably has a polyethylene terephthalate (hereinafter referred to as "PET") and polybutylene terephthalate as main components thereof, more preferably PET alone as a main component thereof. Part of the dicarboxylic acid moiety thereof may be substituted by isophthalic acid, 2,6-naphthalenedicarboxylic acid, 1,4-cyclohexanedicarboxylic acid, adipic acid, sebacic acid, dimer acid, and isophthalic acid containing a metal salt of sulfonic acid as a substituent, for example. Part of the glycol moiety thereof may be substituted by diethylene glycol, neopentyl glycol, 1,4-cyclohexane diol, 1,4-cyclohexanedimethanol, and polyalkylene glycol, for example. It is permissible to use an addition of a small amount of a chain-branching agent such as pentaerythritol, trimethylol propane, trimellitic acid, trimesic acid, or boric acid. The polyester may further incorporate therein particles of various inorganic substances such as titanium dioxide, silicon oxide, calcium carbonate, silicon nitride, clay, talc, kaolin, and zirconium acid, particles of cross-linked macromolecular compounds, particles of various metals, and other known additives such as antioxidant, metal ion sequestrant, ion exchanger, antistaining agent, light-resisting agent, flame retardant, inclusion compound, antistatic agent, various coloring agent, wax, silicone oil, various fluorine type surfactants, and various reinforcing fibers. The polyester of this invention may have two or more species of such modified polyester resins as mentioned above blended therewith, and may have other resins, such as polyamide, polyester amide, epoxy resin, silicone resin, polyolefin resin, various species of rubber, polycarbonate, polyurethane and polyacrylates additionally incorporated therein.

The concentration of a terminal carboxyl group in the polyester monofilament of this invention must not be more than 10 equivalent weights/$10^6$ g of polyester. This concentration of the terminal carboxyl group is determined by the method proposed by Pohl in "ANALYTICAL CHEMISTRY," Vol. 26, page 1,614. If the concentration of the terminal carboxyl group exceeds 10 equivalent weights/$10^6$ g of polyester, there arises a disadvantage in that the produced monofilament acquires an unduly low resistance to hydrolysis.

The production of a polyester monofilament having a concentration of a terminal carboxylic group of not more than 10 equivalent weights/$10^6$ g of polyester, as contemplated by this invention, is attained by causing a polyester having a concentration of a terminal carboxyl group that exceeds 10 equivalent weights/$10^6$ g of polyester to react in the molten state with a suitable amount of either an epoxy compound such as phenyl glycidyl ether, N-glycidyl phthalimide, o-phenyl phenyl glycidyl ether, ethylene oxide, and propylene oxide, or an oxazole, as generally practised. Since the polyester monofilament of this invention is a carbodiimide compound in an unaltered form in an amount of not less than 0.005% by weight and not more than 1.5% by weight, it is advantageous to use a carbodiimide compound containing at least one carbodiimide group in the molecular unit thereof, for producing a polyester monofilament having a concentration of the terminal carboxyl group of not more than 10 equivalent weights/$10^6$ g of polyester. To be specific, it is advantageous to add to the polyester the carbodiimide compound in an amount calculated, based on the concentration of the terminal carboxyl group in the polyester as the raw material and the reaction conditions to be involved, for the polyester resulting from the reaction to contain the carbodiimide compound in an unaltered form in a concentration of not less than 0.005% by weight and not more than 1.5% by weight, and then cause a reaction therebetween.

The limiting viscosity number of the polyester monofilament of this invention is generally required only to exceed 0.6. The limiting viscosity number involved herein is the limit of viscosity measured in an orthochlorophenol solution of a given sample at 25° C. and reported as $[\eta]$.

For the effect of this invention to be manifested at the highest possible efficiency, the polyester preferably incorporates therein a phosphorus compound in an amount not exceeding 50 ppm as phosphorus atoms and within the following range:

$$5\times10^{-3}\leqq P\leqq M+8\times10^{-3}$$

(wherein P stands for the ratio of phosphorus atom, mol %, to the dibasic acid forming the polyester and M for the ratio of at least one metal atom selected from among the elements of families II, VII, and VIII and periods 3 and 4 in the Periodic Table of Elements, mol %, to the dibasic acid forming the polyester, providing that M=0 is allowed).

The carbodiimide compound to be contained in the polyester monofilament of this invention is desired to be a compound containing at least one carbodiimide group in the molecular unit thereof. The carbodiimide compounds which are effectively usable herein include N,N'-di-o-tolylcarbodiimide N,N'-diphenylcarbodiimide, N,N'-dioctyldecylcarbodiimide, N,N'-di-2,6-dimethylphenylcarbodiimide, N-tolyl-N'-cyclohexylcarbodiimide, N,N'-di-2,6-diisopropylphenylcarbodiimide (hereinafter referred to as "TIC"), N,N'-di-2,6-di-tert.-butylphenylcarbodiimide, N-tolyl-N'-phenylcarbodiimide, N,N'-di-p-nitrophenylcarbodiimide, N,N'-di-p-aminophenylcarbodiimide, N,N'-di-p-hydroxyphenylcarbodiimide, N,N'-di-cyclohexylcarbodiimide, N,N'-di-p-tolylcarbodiimide, p-phenylene-bis-di-o-tolylcarbodiimide, p-phenylene-bisdicyclohexylcarbodiimide, hexamethylene-bisdicyclohexylcarbodiimide, ethylene-bisdiphenylcarbodiimide, and aromatic polycarbodiimides represented by the following general formula.

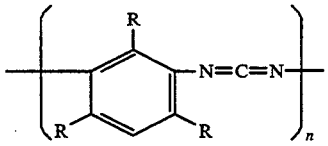

(wherein R stands for a hydrogen atom or an alkyl group of 1 to 4 carbon atoms and n for an interger of from 2 to 20 inclusive). One member or a mixture of two or more members selected from the group of carbodiimide compounds mentioned above the incorporated in the polyester as described above. To ensure the stability of the carbodiimide compound after the addition to the polyester, this carbodiimide compound preferably has an aromatic backbone. In this respect, TIC, N,N'-di-2,6-di-tert.-butylphenylcarbodiimide, N,N'-di-2,6-dimethylphenylcarbodiimide, N,N'-di-o-tolylcarbodiimide are particularly preferable among other carbodiimide compounds cited above. In terms of reactivity, TIC is most preferable.

The concentration of the carbodiimide compound to be contained in an unaltered form in the polyester monofilament of this invention must be not less than 0.005% by weight and not exceed 1.5% by weight. Preferably, this range is from the lower limit of 0.01% by weight to the upper limit of 1.2% by weight. The resistance of the produced polyester monofilament to hydrolysis is poor if the concentration is less than 0.005% by weight, and the physical properties of the monofilament are poor if the concentration exceeds 1.5% by weight.

The content of the carbodiimide compound in an unaltered form in the polyester monofilment involved in this invention is determined by the following method.

A given polyester monofilament sample of the amount 100 g was cut into small pieces 2 to 3 mm and boiled in 500 cc of chloroform for 8 hours. After the treatment, the polyester monofilament was removed from the solvent and the residual solvent was distilled to expel chloroform. The extract consequently obtained was combined with 50 cc of methanol and the insolubles were separated by filtration. The resultant methanol solution was vacuum distilled to expel the greater part of the methanol. The extract was concentrated to an extent short of inducing deposition thereof. The methanol solution was analyzed by gas chromatography to quantify the concentration of the carbodiimide compound.

The mixture and reaction of the polyester with the carbodiimide compound can be accomplished by a method which comprises adding the carbodiimide compound to the polyester in a molten state fresh from the completion of polycondensation reaction, and stirring thereby inducing a reaction thereof, a method which comprises mixing polyester chips with the carbodiimide compound and then kneading the resultant mixture in a reactor or an extruder to thereby cause a reaction, or a method which comprises continuously adding the carbodiimide compound in a liquid state to the polyester by an extruder, and kneading to thereby caused a reaction, for example.

The fluorine type polymer to be used in this invention may be any compound as long as it contains a fluorine atom in the molecular unit thereof. The fluorine type polymers effectively usable herein include fluorine type polymers having a fluorine atom mainly in the main chain of polymer molecule such as random copolymers having tetrafluoroethylene and ethylene as main components thereof (hereinafter referred to as "ETFE"), polychloro-trifluoroethylene (hereinafter referred to as "PCTFE"), polyvinylidene fluoride (hereinafter referred to as "PVdF"), vinylidene fluoridetetrafluoroethylene copolymer (hereinafter referred to as "2F-4F"), polytetrafluoroethylene (hereinafter referred to as "PTFE), tetrafluoroethylene-perfluoroalkylvinyl ether copolymers (hereinafter referred to as "PEA"), and tetrafluoroethylene-hexafluoropropylene copolymer (hereinafter referred to as "FEP"), random or block copolymers of acrylates and/or methacrylates possibly containing a hydroxyalkyl group such as polyperfluoroalkyl-acrylate, polyperfluoroalkylmethacrylate, perfluoroalkyl-acrylate, and/or perfluoroalkyl-methacrylate, and fluorine type polymers containing a fluorine atom in the side chain of polisher molecule such as polyesters or polyether polyesters containing o- or m-perfluorcoxyisophthalic acid in at least part of the dicarboxylic acid moiety thereof, for example. The incorporation of the fluorine type polymer in the polyester monofilament of this invention is accomplished simply by selecting one member or a mixture of two or more members from among the examples of the fluorine type polymers mentioned above and causing it to be contained in the polyester. Among other fluorine type polymers cited above, especially among other fluorine type polymers having a fluorine atom in the main chain of polymer molecule, ETFE proves particularly preferable in that it is readily moldable within the range of melt-molding temperature of the polyester and effectively enhances the ability to resist hydrolysis and ensures proof against staining.

The ETFE may optionally incorporate therein besides tetra-fluoroethylene and ethylene one component selected from among monochlorotrifluoroethylene, perfluoroacrylate, perfluoroalkyl-acrylate, perfluoroalkylvinyl ether, hexafluoropropylene, and vinylidene fluoride in a copolymerized form in an amount of approximately from 0.1 to 10% by weight.

The content of fluorine atom in the ETFE has the upper limit thereof set in the neighborhood of 69% by weight, based on the amount of the copolymer consisting of ethylene and tetrafluoro-ethylene at a ratio of 1:1. To impart a high level of proof against staining and a resistance to hydrolysis to the produced polyester monofilament, the ETFE preferably contains at least 40% by weight of fluorine atom. When the ETFE to be used has a fluorine atom content of at least 42% by weight, preferably at least 46% by weight, the produced polyester monofilament more advantageously manifests a level of proof against staining and a resistance to hydrolysis.

The fluorine content in the ETFE mentioned above was determined by preparing a plate by a compression-molding of chips of a given ETFE sample, measuring the fluorescent X-ray intensity of the fluorine atom content of this plate by using a wholly automatic X-ray analytical device (produced by Rigaku K.K. and marketed under product code of "3080E2"), and comparing this fluorescent X-ray intensity with the fluorescent X-ray intensity of fluorine atom obtained from polytetrafluoroethylene (fluorine atom content 76.0% by weight).

When chips of ETFE have a composition such that the fluorine atom-containing component extracted from the chips with hexafluoro-isopropanol solvent accounts for a proportion of not less than 20 ppm based on the amount of the ETFE chips before extraction is adopted as the ETFE, the polyester monofilament to be produced enjoys an even greater level of proof against staining and resistance to hydrolysis. Although the reason for this improvement remains to be elucidated, the improvement may be logically explained by postulating that the fluorine atom-containing component of the nature extractable from the ETFE with hexafluoroisopropanol is dissolved out and diffused in the polyester.

The amount of the extracted component from the ETFE chips and the inclusion of fluorine atom in the extracted component were confirmed by the following method.

In a flask provided with a reflux condenser, a stirrer, and a heating device, 100 g of ETFE chips and 200 g of hexafluoroisopropanol were boiled under normal pressure at the boiling point of hexafluoroisopropanol for 7 hours to effect extraction and then left to cool to normal room temperature. Then, the cooled mixture was passed through a glass filter of 17G-4 and further passed through a filter having a mesh of 1 micron. The filtrate was centrifuged at 1,600 rpm and the supernatant was decanted to remove extraneous substances and obtain a hexafluoroisopropanol solution. Then, this solution was distilled to expel hexafluoroisopropanol by evaporation, and further, vacuum dried at normal room temperature to obtain the extracted component. This extracted component was subjected to infrared absorption analysis to detect absorption by the C-F expansion vibration at 1,400 to 1,000 $cm^{-1}$ in the infrared absorption spectrum, as a sign of the presence of fluorine atom in the extracted component.

The content of the fluorine type polymer in the polyester monofilament must be not less than 0.01% by weight and not less than 30% by weight. No sufficient improvement is obtained in the resistance to hydrolysis and no proof against staining is manifested if this content is less than 0.01% by weight, and the physical properties of the polyester monofilament are impaired if the content exceeds 30% by weight. Preferably, the range of this content is from the lower limit of 0.5% by weight to the upper limit of 15% by weight.

The addition of the fluorine type polymer to the polyester for incorporation therein is achieved by a method which comprises adding the fluorine type polymer to the polyester in a molten state either during or immediately after the reaction of polycondensation, and kneading the resultant mixture, or a method which comprises adding chips or particles of the fluorine type polymer to chips of the polyester resin and kneading by an extruder, for example.

In the case of a random or block copolymer of polyperfluoroalkyl-acrylate, polyperfluoroalkylmethacrylate, perfluoroalkyl-acrylate and/or perfluoroalkylmethacrylate with an acrylate and/or methacrylate optionally including a hydroxyalkyl group, this copolymer may be dissolved in a suitable organic solvent such as ketone or acetic ester and then the resultant solution may be added to the polyester. It is also permissible to mix, in a suitable ratio, a fluorine type polymer having a fluorine atom mainly in the main chain of polymer molecule with a fluorine type polymer having a fluorine atom in the side chain of polymer molecule, and add the resultant mixture to the polyester.

In the polyester monofilament of this invention, the fluorine type polymer is present in a state dispersed in the polyester. In the dispersed state in the polyester, the fluorine type polymer may assume a varying form such as, for example, the form of particles or the form of fibrils. When the fluorine type polymer is present as dispersed in the form of fibrils having an average length of not less than 10 μm and an average diameter of not less than 0.15 μm and not more than 2 μm, it produces a desirable effect of imparting a conspicuously enhanced resistance to hydrolysis to the produced polyester monofilament, as intended by this invention.

The polyester monofilament containing the fluorine type polymer dispersed in the form of fibrils having an average length of 10 μm and an average diameter of not less than 0.15 μm can be produced by kneading ETFE whose melt flow rate measured at 297° C. under a load of 5 kg in accordance with the method specified in ASTM D3159 is in the range of from 2 to 40 g/10 minutes, preferably from 3 to 25 g/10 minutes, with the carbodiimide compound in a monoaxial extruder and melt spinning and drawing the resultant mixture as generally practised.

The state of dispersion of the fluorine type polymer in the polyester monofilament was evaluated by removing an extremely thin slice from a monofilament sample along cuts inserted one each in the directions perpendicular and parallel to the axis of filament by the use of a diamond cutter, staining the slide with $RuO_4$, taking a micrograph of the slice with a transmission type electron microscope (produced by Japan Electron Optics Laboratory Co., Ltd. and marketed under product code of "EM-1200EX") at 5,000 to 40,000 magnifications, and measuring the diameter of dispersion and the length of dispersion of individual fluorine type polymer fibrils appearing on the micrograph. It was nearly impossible to determine with the transmission type electron microscope the exact lengths of those individual fluorine type polymer fibrils dispersed in the polyester monofilament, which showed lengths of dispersion exceeding about 25 μm, because the field of vision available for the measurement was limited and the separation of the slice perfectly parallel to the axis of filament was attained only with difficulty.

For an evaluation of dispersibility in the direction of length, as one approach to the elimination of the drawback mentioned above, a method which, although deficient in quantitativeness, comprises preparing a piece of the monofilament sample cut in a length of 1 to 2 cm, placing this piece in o-chlorophenol held in a test tube, heating this test tube to about 100° C. to thereby gently dissolve and remove the PET component, and consequently, exposing to visual observation the fluorine type polymer insoluble in o-chlorophenol, is available. In accordance with this method, although relatively short fluorine type polymer fibrils short of 10 μm are dispersed in o-chlorophenol and cannot be observed, relatively long fluorine type polymer fibrils exceeding 10 μm can be observed as aggregates of fibrils approximating closely the cut length of 1 to 2 cm before solution in the solvent.

The production of the polyester monofilament of this invention is accomplished by preparing the polyester containing the carbodiimide compound and the fluorine type polymer as described above, passing this polyester through a polymer stream switch and a filter set in the leading end part of an extruder and extruding it through a spinneret, and cooling, drawing, and heat-setting the extruded thread of the polyester as conventionally practised.

The polyester monofilament of this invention may be a core-sheath composite monofilament having a core made of a carbodiimide compound-containing polyester not containing the fluorine type compound and a sheath made of the polyester containing both the fluorine type polymer and the carbodiimide compound or a core-sheath composite monofilament having a core and a sheath both made of the polymer containing the fluorine type polymer and the carbodiimide compound and the core and the sheath, are differentiated from each other by the content of the fluorine polymer and/or the kind of the fluorine type polymer.

The polyester monofilament of this invention is a continuous line of one thread having any desired cross-sectional shape, such as circle, flattened figure, square, triangle, pentagon and polygons, multifoil, dumbbell, and cocoon. When this monofilament is intended as a warp in a papermaking drier canvas, the monofilament having the cross section of a flattened figure is advantageously used from the viewpoint of improving the level of proof against staining and ensuring a flatness of the produced drier canvas. The term "flattened figure" as used in this invention refers to an ellipse or a rectangle. The term embraces not merely a geometrically defined exact ellipse and rectangle but also shapes roughly similar to an ellipse and a rectangular and a shape obtained by rounding the four corners of a rectangle. The ellipse and the rectangle are such that the long axis (LD) and the short axis (SD), which perpendicularly intersect at the center of the ellipse, and the long side (LD) and the short side (SD) of the rectangle fulfil the segment passing relationship represented by the following formula.

$$1.2 \leqq LD/SD \leqq 6$$

The length of a line along the center of gravity of the cross section of the monofilament is preferably from 0.10 to 2.5 mm.

The cross-sectional shapes effectively usable for the polyester monofilament of this invention include square, triangle, pentagon and higher polygons, multifoil, dumbbell, and cocoon, besides the flattened figure mentioned above. Concrete examples of the cross-sectional shape are illustrated in FIG. 2. When the cross-sectional shape of the polyester monofilament is a square, a triangle, a pentagon or higher polygon, or a multi-foil, the deformation of this cross section which possibly occurs in the monofilament when the papermaking drier canvas made of the mono-filament is in use can be curbed. When the cross-sectional shape of the polyester monofilament of this invention is a dumbbell or a cocoon when this polyester monofilament is used in a papermaking drier canvas, the produced paper enjoys an ideal finish because the air-passing property of the canvas is adjusted and the distribution of the degree of dryness of paper within the drier is uniformized.

If the diameter of the monofilament is less than 0.10 mm, a disadvantage arises in that the monofilament, when used under the harsh conditions of high temperature and high humidity as experienced in the papermaking drier canvas, undergoes an accelerated deterioration. Although the reason for this disadvantage remains to be elucidated, this disadvantage may be logically explained by postulating that the fluorine resin in the monofilament and the fluorine atom-containing compound exuding into the PET part from the fluorine resin inhibits the infiltration of the water responsible for hydrolysis of PET through the surface into the interior of the monofilament synergistically with the growing depth of water infiltration. Since this inhibition of the infiltration of water is not sufficient on the surface of the monofilament and in the region relatively close to the surface layer, the hydrolysis of the PET proceeds more quickly on the surface of the monofilament and in the region relatively close to the surface layer than in the interior of the monofilament. If the diameter of the monofilament is less than 0.10 mm, therefore, the ratio of the PET part in which the hydrolysis does not proceed as much as in the surface layer region, i.e., the factor which governs the high strength exhibited by the monofilament under the harsh conditions of high temperature and high humidity, is lowered. Conversely, if the thickness of the monofilament exceeds 2.5 mm, the production of a papermaking drier canvas by the weaving of the monofilament is obtained only with difficulty.

Optionally, such known additives as a water-repellent agent, oil-repellent agent and lubricant may be imparted to the surface of the monofilament.

The polyester monofilament of this invention conspicuously excels the conventional countertype in the resistance to hydrolysis and proof against staining.

The reason for the prominently higher resistance offered by the polyester monofilament of this invention to hydrolysis than the resistance offered by the conventional polyester monofilament is the synergistic effect of three factors, i.e. that the unaltered carbodiimide compound and fluorine type polisher contained in the polyester monofilament of this invention and the polyester as the matric substance of the monofilament invariably have low carboxyl terminal group concentrations. It is universally known that the hydrolysis of the polyester is caused by the infiltrating water and the heat, that this hydrolysis is accelerated by the carboxyl terminal group of the polyester, and that the hydrolysis of the polyester increases the carboxyl terminal group of the polyester and this growth of the carboxyl terminal group in turn further accelerates the hydrolysis of the polyester. The carbodiimide compound, by reacting with the carboxyl terminal group of the polyester, functions to deprive the carboxyl terminal group of the ability to promote the hydrolysis of the polyester. The carbodiimide compound by nature reacts with water at elevated temperatures and consequently loses its reactivity with the carboxyl terminal group of the polyester. By obtaining a fine dispersion in the polyester, the fluorine type polymer having an excellent water repellency functions to inhibit the infiltration of water into the polyester. The resistance offered by the monofilament of this invention to hydrolysis excels the sum of the aforementioned three factors for inhibiting the hydrolysis of the polyester. The polyester monofilament of this invention first curbs the initial hydrolysis by lowering the carboxyl terminal group concentration of the polyester which functions to promote hydrolysis and then, owing to the low concentration of the carboxyl terminal group, facilitates the presence in the polyester of the carbodiimide compound in a substantially unaltered state. Further, the fact that the polyester contains the fluorine type polymer restrains the infiltration of water into the polyester, further curbs the hydrolysis of the polyester, precludes the increase of the carboxyl terminal group, and inhibits the consumption of the unaltered carbodiimide compound through reaction with the carboxyl terminal group and water. The unaltered carbodiimide compound, which is present in the polyester, reacts with the carboxyl terminal group formed in consequence of hydrolysis and prevents the increase of the carboxyl terminal group in the polyester, and further, enhances the ability of the polyester to resist hydrolysis. The polyester monofilament of this invention excels the conventional countertype in resistance to hydrolysis not because the aforementioned three factors function independently of one another but because these three factors interact and manifest a synergistic effect.

The polyester monofilament of this invention constitutes itself an ideal raw filament for a papermaking drier canvas which is used for the production of medium-grade paper, newspaper, and various hard boards. When the polyester monofilament of this invention is used as the raw filament for the papermaking drier canvas, the defilement and deterioration of the drier canvas during the process of papermaking is alleviated, the quality of produced paper is stabilized, and the cycle of cleaning and the service life of the canvas are conspicuously elongated.

As described above, the polyester monofilament of this invention is suitable for the papermaking drier canvas because it excels the conventional countertype in resistance to hydrolysis and proof against staining.

BEST MODE OF CARRYING OUT THE INVENTION

Now this invention will be described in detail below with reference to working examples.

The proof against staining mentioned in the working examples was evaluated by the following method.

(1) Preparation of polluting liquid: This liquid was prepared by combining 1 part by weight of talc, 0.5 part by weight of alkyl ketene dimer, 0.5 part by weight of acrylamide, and 98 parts by weight of water. This polluting liquid closely approximated the composition of a stain generally collected on the papermaking drier canvas and water.

(2) Preparation of sample monofilament:

A sample of stained monofilament was obtained by keeping the polluting liquid at 300 rpm, immersing a monofilament of known weight for 5 seconds in a goods-to-liquor ratio of 1:5,000 in the stirred polluting liquid, drying the wetted sample monofilament at 70° C.

for 1 minute, and performing this procedure repeatedly a total of ten times.

(3) Evaluation:

The stained sample monofilament was weighed to find the amount of stain deposited thereon.

EXAMPLE 1

Figure 1:
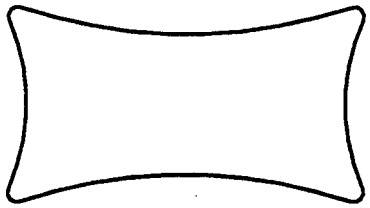
FIG. 1 illustrates the shape of a discharge orifice for the production of a monofilament having a roughly rectangular cross section as described in Example 1.
Figure 2A:
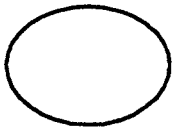
FIG. 2 illustrates a concrete example of the cross-sectional shape of a polyester monofilament of this invention.
Figure 2B:
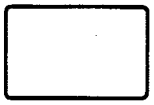
Figure 2C:
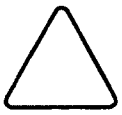
Figure 2D:
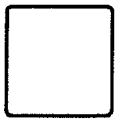
Figure 2E:
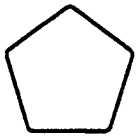
Figure 2F:
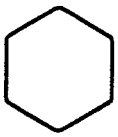
Figure 2G:
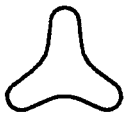
Figure 2H:
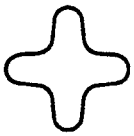
Figure 2I:
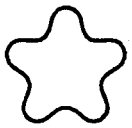
Figure 2J:
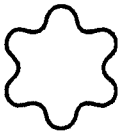
Figure 2K:
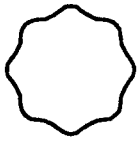
Figure 2L:
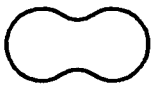
Figure 2M:
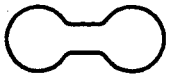

Dry chips of PET having a limiting viscosity number of 0.93 and a terminal carboxyl group concentration of 20 equivalent weights/$10^6$ g of PET {containing as catalysts 300 ppm as antimony atom of an antimony compound, 60 ppm as manganese atom of a manganese compound (0.021 mol % as manganese atom, based on terephthalic acid), and 30 ppm as phosphorus atom of a phosphorus compound (0.019 mol % as phosphorus atom, based on terephthalic acid)} and chips of ETFE having 240 ppm of extractables with hexafluoroisopropanol, 48% by weight of a fluorine atom content determined by the fluorescent X-ray method, and a melt flow rate of 9 g/10 minutes determined under the conditions of 297° C. and 5 kg in accordance with ASTM D-3195 were mixed at a weight ratio, PET/ETFE, of 100/6 to obtain PET-ETFE blended chips. The PET-ETFE blended chips and TIC as a carbodiimide compound were mixed in a weight ratio, PET chips/carbodiimide compound, of 100/1.63 and the resultant mixture was supplied to the inlet part of an extruder. The mixture was melted and kneaded at 300° C. for 3 minutes therein and the resultant molten polymer at 300° C. was passed by a gear pump through a filter layer and a stream switch device (produced by Chemix Corp of U.S. and marketed under the trademark of "Static Mixer") disposed in a spinning pack and extruded through a discharge orifice illustrated in FIG. 1. The extruded monofilament was cooled in a hot bath at 80° C. and then drawn to six times the original length and heat-set as generally practised, to obtain a monofilament having a roughly rectangular cross section (0.56 mm in long side and 0.28 mm in short side). This monofilament was tested for strength, terminal carboxyl group content, TIC content, and level of proof against staining, and was left standing in an atmosphere of saturated steam at 120° C. for 10 days to determine the ability thereof to retain its strength. The results are shown in Table 1.

From a photograph of this monofilament taken through an ETFE transmission type electron microscope, it was found that the average diameter of dispersion of 0.23 μm and the average length of fibrils perceivable at all was 15.4 μm. For reference, a portion of this monofilament about 1.5 cm in length was placed in 15 cc of o-chlorophenol held in a test tube and treated at 105° C. for 30 minutes, to dissolve PET. After this treatment, the o-chlorophenol in the test tube was found to contain a white object about 1.2 cm in length. This white object was washed with clean o-chlorophenol and methanol and then observed under an optical microscope. It was consequently confirmed that this white object was an aggregate of fibrils exceeding 10 μm in length and containing numerous fibrils exceeding 180 μm in length, although most of the individual fibrils were intertwined and could not be measured exactly.

COMPARATIVE EXAMPLES 1 AND 2

In Comparative Example 1, a monofilament was produced by similarly following the procedure of Example 1, except that the use of ETFE chips was omitted. In Comparative Example 2, a monofilament was obtained by similarly following the procedure of Example 1, except that the use of TIC was omitted. These monofilaments were tested in the same manner as in Example 1. The results are shown in Table 1.

EXAMPLES 2 TO 5 AND COMPARATIVE EXAMPLES 3 TO 6

Monofilaments were obtained by following the procedure of Example 1, except that the mixing ratio of ETFE chips was varied as shown in Table 1 (Examples 2 and 3 and Comparative Examples 3 and 4) and the amount of TIC was varied (Examples 4 and 5 and Comparative Examples 5 and 6). The monofilaments were tested in the same manner as in Example 1. The results are shown in Table 1.

TABLE 1

| | Number of parts by weight of fluorine resin/100 parts by weight of PET | Amount of TIC added (wt %) | Strength (g/d) | Terminal COOH group concentration (equivalent weight/$10^6$ g) | Unaltered TIC content (wt %) | Evaluation of level of proof against staining (index based on result of C.E. 1 taken as 100) | Ratio of retention of strength after treatment for hydrolysis (%) |
|---|---|---|---|---|---|---|---|
| Example 1 | 6 | 1.63 | 5.29 | 2 | 0.16 | 65 | 84 |
| Comparative Example 1 | 0 | 1.63 | 5.31 | 2 | 0.16 | 100 | 72 |
| Comparative Example 2 | 6 | 0 | 5.29 | 27 | 0 | 66 | 0 |
| Example 2 | 1 | 1.63 | 5.30 | 2 | 0.16 | 71 | 80 |
| Example 3 | 12 | 1.63 | 4.42 | 2 | 0.16 | 58 | 87 |
| Example 4 | 6 | 0.85 | 5.30 | 9 | 0.01 | 65 | 78 |
| Example 5 | 6 | 3.50 | 4.52 | 1 | 1.43 | 64 | 85 |
| Comparative Example 3 | 0.008 | 1.63 | 5.30 | 2 | 0.16 | 98 | 73 |
| Comparative Example 4 | 32 | 1.63 | 4.03 | 2 | 0.16 | 57 | 87 |
| Comparative Example 5 | 6 | 0.60 | 5.30 | 14 | Not detectable | 66 | 69 |
| Comparative Example 6 | 6 | 4.20 | 4.11 | 1 | 1.60 | 64 | 86 |

EXAMPLES 6 TO 11

Monofilaments were obtained by following the procedure of Example 1, excepting PVdF chips (Example 6), PCTFE chips (Example 7), 2F-4F chips (Example 8), and PTFE powder (Example 9) were respectively used in the place of ETFE chips as a fluorine type polymer. These monofilaments were tested in the same manner as in Example 1. The results are shown in Table 2. Similarly, monofilaments were obtained by following the procedure of Example 1, excepting a block copolymer powder of perfluoroalkyl-methacrylate and methacrylate was used in an amount of 0.7 part by weight based on 100 parts by weight of polyethylene terephthalate chips (Example 10) and a random copolymer powder of perfluoroalkylmethacrylate and methacrylate was used in an amount of 0.9 part by weight based on 100 parts by weight of polyethylene terephthalate chips (Example 11) respectively in the place of ETFE chips as a fluorine type polymer. These monofilaments were tested in the same manner as in Example 1. The results are shown in Table 2. From these results, it is noted that the polyester monofilaments conforming to this invention conspicuously excelled against the conventional countertypes in resistance to hydrolysis and level of proof against staining, and proved highly useful.

TABLE 2

| | Number of parts by weight of fluorine resin/100 parts by weight of PET | Amount of TIC added (wt %) | Strength (g/d) | Terminal COOH group concentration (equivalent weight/$10^6$ g) | Unaltered TIC content (wt %) | Evaluation of proof against staining (index based on result of C.E. 1 taken as 100) | Ratio of retention of strength after treatment for hydrolysis (%) |
|---|---|---|---|---|---|---|---|
| Example 6 | 6 | 1.63 | 5.29 | 2 | 0.16 | 68 | 79 |
| Example 7 | 6 | 1.63 | 5.30 | 2 | 0.15 | 66 | 80 |
| Example 8 | 6 | 1.63 | 5.28 | 2 | 0.16 | 69 | 78 |
| Example 9 | 6 | 1.63 | 5.30 | 2 | 0.16 | 66 | 79 |
| Example 10 | 0.7 | 1.63 | 5.30 | 2 | 0.16 | 73 | 77 |
| Example 11 | 0.9 | 1.63 | 5.30 | 2 | 0.15 | 72 | 78 |

EXAMPLE 12

A monofilament was obtained by following the procedure of Example 1, excepting the shape of the discharge orifice was changed to a circle and the cross-sectional shape of the monolilament was changed to a circle 0.45 mm in diameter. This monofilament was tested in the same manner as in Example 1. The results are shown in Table 3.

EXAMPLE 13

A monofilament was obtained by following the procedure of Example 1, excepting the ETFE was changed to a species whose extract from hexafluoroisopropanol was in an amount of 98 ppm and whose fluorine atom content determined by the fluorescent X-ray method was 43% by weight. This monofilament was tested in the same manner as in Example 1. The results are shown in Table 3.

EXAMPLE 14

A monofilament was obtained by following the procedure of Example 1, except that the ETFE was changed to a species whose extract from hexafluoroisopropanol was in an amount of 89 ppm and whose fluorine atom content determined by the fluorescent X-ray method was 41% by weight. This monofilament was tested in the same manner as in Example 1. The results are shown in Table 3.

EXAMPLE 15

A monofilament was obtained by following the procedure of Example 1, except that the ETFE was changed to a species whose extract from hexafluoroisopropanol was in an amount of 45 ppm and whose fluorine atom content determined by the fluorescent X-ray method was 38% by weight. This monofilament was tested in the same manner as in Example 1. The results are shown in Table 3.

COMPARATIVE EXAMPLE 7

A monofilament was obtained by following the procedure of Example 1, except that the amount of ETFE to be added was changed to 8% by weight and the addition of TIC was omitted. This monofilament was tested in the same manner as in Example 1. The results are shown in Table 3.

EXAMPLE 16

A monofilament was obtained by following the procedure of Example 1, except that TIC was changed to N,N'-di-o-tolylcarbodiimide. The monofilament was tested in the same manner as in Example 1. The results are shown in Table 3. During this experiment, immediately below the spinneret, the discharged thread vigorously emitted smoke on account of N,N'-di-o-tolyl carbodiimide.

EXAMPLE 17

A monofilament was obtained by following the procedure of Example 1, except that the content of the phosphorus compound in the PET chips was changed to 60 ppm. This monofilament was tested in the same manner as in Example 1. The results are shown in Table 3.

COMPARATIVE EXAMPLE 8

A monofilament was obtained by following the procedure of Comparative Example 1, except that the shape of the discharge orifice was changed to a circle and the cross-sectional shape of the monofilament was changed to a circle 0.45 mm in diameter. This monofilament was tested in the same manner as in Example 1. The results are shown in Table 3.

EXAMPLE 18

A monofilament was obtained by following the procedure of Example 1, except that the ETFE was changed to a species whose melt flow rate determined under the conditions of 297° C. under 5 kg in accordance with ASTM D-3159 was 45 g/10 minutes. This monofilament was tested in the same manner as in Example 1. The results are shown in Table 3. From a photograph of this monofilament taken through a transmission type electron microscope, it was found that the average diameter of dispersion of ETFE was 0.09 μm and the average length thereof was 1.1 μm.

EXAMPLE 19

A monofilament was obtained by following the procedure of Example 12, except that the diameter of the monofilament was changed to 0.05 mm. This monofilament was tested in the same manner as in Example 12. The results are shown in Table 3.

EXAMPLE 20

A monofilament was obtained by following the procedure of Example 1, except that the amount of TIC was changed to 0.81% by weight. This monofilament was tested in the same manner in Example 1. The result are shown in Table 3.

EXAMPLE 21

A monofilament was obtained by following the procedure of Example 1, except that the amount of ETFE based on 100 parts by weight of PET was changed to 0.02 part by weight. This monofilament was tested in the same manner as in Example 1. The results are shown in Table 3.

TABLE 3

| | Number of parts by weight of fluorine resin/100 parts by weight of PET | Amount of TIC added (wt %) | Strength (g/d) | Terminal COOH group concentration (equivalent weight/$10^6$ g) | Unaltered TIC content (wt %) | Evaluation of level of proof against staining (index based on result of C.E. 1 taken as 100) | Ratio of retention of strength after treatment for hydrolysis (%) |
|---|---|---|---|---|---|---|---|
| Example 12 | 6 | 1.63 | 5.17 | 2 | 0.16 | 68 | 81 |
| Example 13 | 6 | 1.63 | 5.15 | 2 | 0.16 | 67 | 80 |
| Example 14 | 6 | 1.63 | 5.15 | 2 | 0.16 | 69 | 79 |
| Example 15 | 6 | 1.63 | 5.16 | 2 | 0.16 | 72 | 77 |
| Example 16 | 6 | 1.63* | 4.96 | 4 | 0.01* | 66 | 77 |
| Example 17 | 6 | 1.63 | 5.15 | 4 | 0.18 | 65 | 77 |
| Example 18 | 6 | 1.63 | 4.79 | 2 | 0.16 | 70 | 75 |
| Comparative Example 7 | 8 | 0 | 5.16 | 26 | 0 | 61 | 8 |
| Example 19 | 6 | 1.63 | 5.14 | 2 | 0.16 | 66 | 72 |
| Comparative Example 8 | 0 | 1.63 | 5.20 | 2 | 0.16 | 100 | 71 |
| Example 20 | 6 | 0.81 | 5.30 | 10 | 0.006 | 65 | 71 |
| Example 21 | 0.02 | 1.63 | 5.30 | 2 | 0.16 | 69 | 77 |

*N,N'-di-o-tolylcarbodiimide

EXAMPLE 22

A papermaking drier will weave canvas was fabricated by using as a warp the monofilament of a flattened figure cross section obtained in Example 1 and as a weft the monofilament of a circular cross section obtained in Example 12. This canvas was set in place in a drier for a neutral papermaking machine and used for drying the produced paper at 140° C. for three months. At the end of this operation, the canvas was removed from the machine. A part of the canvas was cut off and subjected to ultrasonic cleaning in a mixed solution of water and acetone (1:1 by volume) containing 0.3% by weight of polyoxyethylene alkyl ether for one hour. The amount of polluting matter found from the difference of weight of the canvas before and after the cleaning was 0.8% by weight. The ratio of residual strength of the warp of the canvas before the cleaning was 84%.

COMPARATIVE EXAMPLE 9

In an experiment performed by following the procedure of Example 20, except that the monofilament used as the warp was changed to the monofilament of a flattened cross section of Comparative Example 1 and the monofilament used as the weft was changed to the monofilament of a circular cross section of Comparative Example 8, the amount of polluting matter deposited was 2.1% by weight and the ratio of residual strength of the warp of the canvas before the washing was 69%.

INDUSTRIAL APPLICABILITY

The polyester monofilament of this invention prominently excels the conventional countertype in resistance to hydrolysis and proof against staining. When this polyester monofilament is used under high temperature and high humidity conditions susceptible to hydrolysis and the collection of stains, as when used in a papermaking drier canvas, it produces a notable effect in prolonging the service life of the canvas and lengthening the cycle of cleaning.

We claim:

1. A polyester monofilament having a terminal carboxyl group concentration of not more than 10 equivalent weights/$10^6$ g of polyester and comprising a carbodiimide compound blended in an unreacted state in an amount of not less than 0.005% by weight and not more than 1.5% by weight and a random copolymer having tetrafluoroethylene and ethylene as main components in an amount of not less than 0.01% by weight and not more than 30% by weight.

2. A polyester monofilament according to claim 1, wherein a dispersoid formed of said random copolymer has an average length of not less than 10 μm and an average diameter of not less than 0.15 μm.

3. A polyester monofilament according to claim 1, wherein said carbodiimide compound is N,N'-di-2,6-diisopropylphenyl carbodiimide.

4. A polyester monofilament according to any of claims 1 to 3, wherein said random copolymer contains fluorine atom in an amount of not less than 40% by weight.

5. A polyester monofilament according to any of claims 1 to 3, wherein said random copolymer contains fluorine atom in an amount of not less than 42% by weight.

6. A polyester monofilament according to any of claims 1 to 3, wherein said random copolymer contains fluorine atom in an amount of not less than 46% by weight.

7. A polyester monofilament according to any of claims 1 to 3, wherein said random copolymer has a fluorine atom containing component extracted from a mixture of said random copolymer and hexafluoroisopropanol in an amount of not less than 20 ppm.

8. A polyester monofilament according to any of claims 1 to 3, wherein the monofilament has a flattened cross-sectional shape.

9. A polyester monofilament according to any of claims 1 to 3, wherein the shortest linear segment passing the center of gravity of a cross section of the monofilament is not less than 0.1 mm.

10. A polyester monofilament according to any of claims 1 to 3, which is used as a component thread for a papermaking drier canvas.

* * * * *